US005738033A

United States Patent [19]

Pryor et al.

[11] Patent Number: 5,738,033

[45] Date of Patent: Apr. 14, 1998

[54] BUMPER AND SLING ARRANGEMENT TO ASSIST BOAT DOCKING

[76] Inventors: Kimberly M. Pryor; Kelly E. Pryor, both of 19225 Greenwood Ridge Rd., Lebanon, Mo. 65536

[21] Appl. No.: 820,010

[22] Filed: Mar. 18, 1997

Related U.S. Application Data

[60] Provisional application No. 60/013,686, Mar. 19, 1996.

[51] Int. Cl.[6] ..... B63B 59/02

[52] U.S. Cl. ..... 114/219; 114/230

[58] Field of Search ..... 114/219, 218, 114/230, 293; 441/3–5

[56] References Cited

U.S. PATENT DOCUMENTS

| | | | |
|---|---|---|---|
| 2,368,558 | 1/1945 | Maloney | 9/17 |
| 3,292,566 | 12/1966 | Russell | 114/219 |
| 3,863,591 | 2/1975 | Wild | 114/230 |
| 4,414,911 | 11/1983 | Belinsky | 114/219 |
| 4,661,077 | 4/1987 | Griffith et al. | 441/84 |
| 4,920,907 | 5/1990 | Richter | 114/219 |
| 4,938,163 | 7/1990 | Capron | 114/219 |
| 5,036,784 | 8/1991 | Wagner | 114/230 |
| 5,560,312 | 10/1996 | McPherson | 114/219 |

FOREIGN PATENT DOCUMENTS

| | | | |
|---|---|---|---|
| 647886 | 10/1962 | Italy | 114/219 |

*Primary Examiner*—Stephen Avila
*Attorney, Agent, or Firm*—Jonathan A. Bay

[57] ABSTRACT

A bumper and sling arrangement assists a user to dock his or her boat to a dock or the like by allowing the user to set-up the sling in slack condition between moorings on the boat and dock, and then allowing the user to tighten the slackness out of the sling until the boat is pulled into the dock. The bumper is suspended from the sling in between the boat and dock. As the sling is tightened, the bumper is compressed between the boat and dock in order to constrain relative movement between the boat and dock to practically eliminate such relative movement, as well as, simultaneously, to cushion what relative movement that cannot be eliminated.

9 Claims, 4 Drawing Sheets

BUMPER AND SLING ARRANGEMENT TO ASSIST BOAT DOCKING

CROSS-REFERENCE TO PROVISIONAL APPLICATION

This application claims the benefit of U.S. provisional application Ser. No. 60/013,686, filed Mar. 19, 1996.

BACKGROUND AND SUMMARY OF THE INVENTION

The invention relates to a bumper and sling arrangement to attach between a boat and a dock. The bumper is suspended from the sling. The sling, in use, after it is set-up slack, then allows a user to tighten in and thereby acts to assist a boater to dock his or her boat against the dock with the bumper resiliently compressed therebetween.

It is an object of the invention to provide assistance to a boater to securely dock his or her boat against a dock or like docking object such that relative movement between the boat and dock is practically eliminated to protect the boat from damage from the dock.

It is an alternate object of the invention to provide a bumper and sling arrangement wherein the bumper is suspended from a sling such that, in use, it is compressible between the boat and dock in order to constrain relative movement between the boat and dock to practically eliminate such relative movement, as well as, simultaneously, to cushion what relative movement that cannot be eliminated.

It is another object of the invention that the bumper preferably be formed as a tubular bladder of elastic material with an air-filled, substantially hollow body.

It is an additional object of the invention that the bumper include cleat arms on it to allow the sling to be lashed around these cleat arms for tidy storage of the bumper and sling arrangement during non-use.

These and other aspects and objects are provided according to the invention in a bumper and sling arrangement that gives assistance to a user to dock his or her boat to a dock or the like by (i) allowing the user to set-up the sling in slack condition between moorings on the boat and dock, and then (ii) allowing the user to tighten the slackness out of the sling until the boat is pulled into the dock. The bumper is suspended from the sling and is allowed to gravitate to some middle position between the boat and dock. As the sling is tightened, the bumper is compressed between the boat and dock in order to constrain relative movement between the boat and dock to practically eliminate such relative movement, as well as, simultaneously, to cushion what relative movement that cannot be eliminated.

The bumper is preferably an elastic bladder having a tubular shape between opposite cap ends. One cap end preferably includes a flange formed with an opening that allows the bumper to be suspended on the sling by insertion of the sling therethrough. The sling can be rigged from various suitable materials including without limitation web straps. For example, the sling can be composed of two web straps conjoined by a friction buckle that allows a user to pull an end of the strap that is threaded through the friction buckle in order to tighten slackness out of the conjoined web straps. The web straps would present two generally opposite ends for attachment between the boat and the dock. These attachments ends can be formed as eye loops for hitching to cleats and the like by simply looping the eye loops thereon of else forming a choker hitch and the like. One or both of these attachment ends of the sling/web straps can carry a safety hook or like connector including without limitation a carabiner and so on.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE INVENTION

Figure 1:
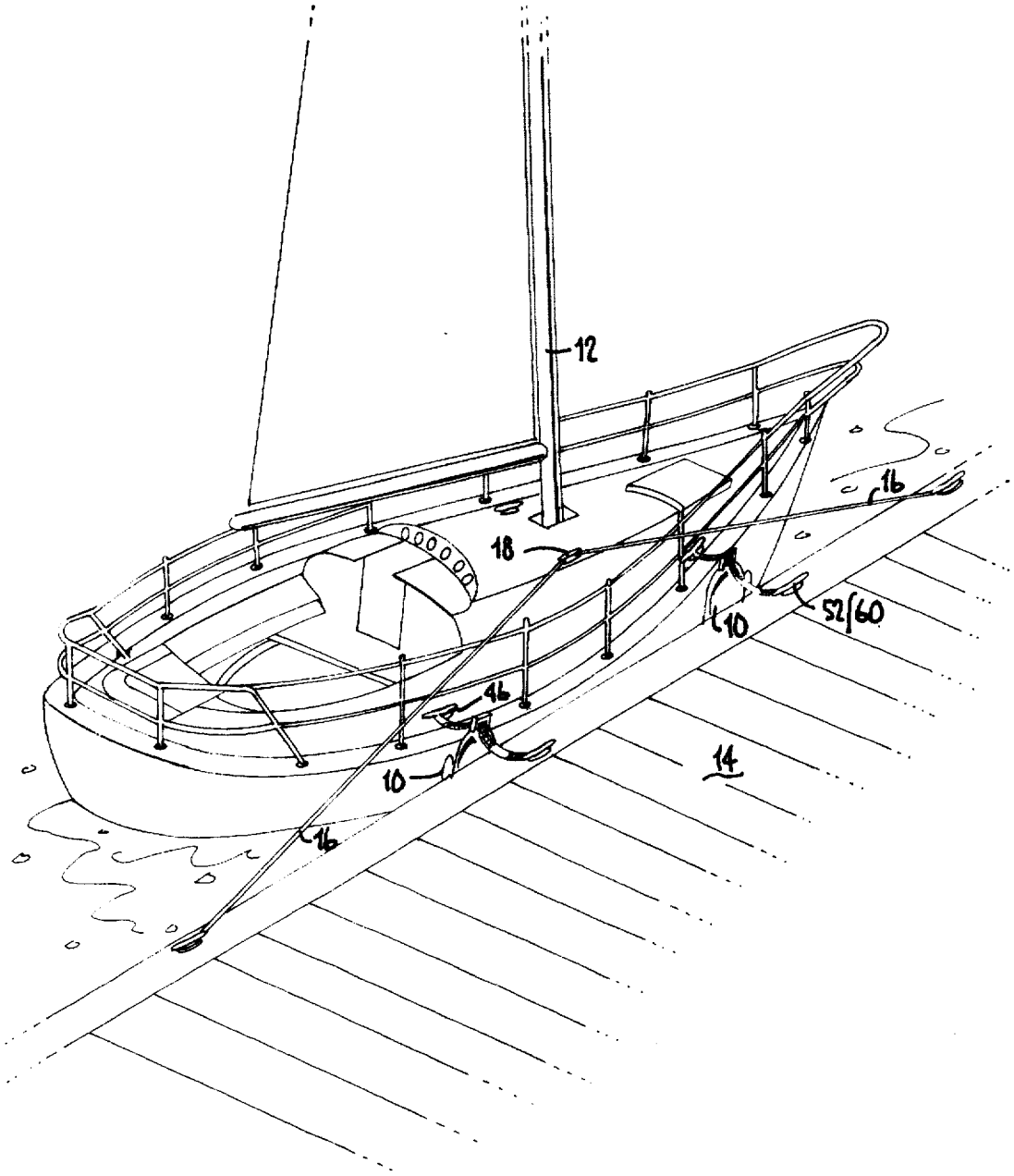
FIG. 1 is a perspective view of two bumper and sling arrangements in accordance with the invention which are useful to assist docking a boat, wherein a sailboat moored against a pier is shown to illustrate one operative use environment for the invention.

In FIG. 1, a pair of bumper and sling arrangements 10 in accordance with the invention are shown in use to moor a sailboat 12 against a 14 landing. The invention is comparably useful in saltwater and freshwater environments. Phraseology such as "moor" and "dock" are used interchangeably to mean generally make fast, and similarly, terms such as "landing," "mooring," "wharf," "pier," and/or "dock" are also used interchangeably to mean generally an object to be docked against. Such phraseology and terminology is used merely for convenience in this description with reference to the drawings and does not limit the invention in any exclusive way because, for example, an object which a boat can be docked against can include without limitation, another boat.

The sailboat 12 in FIG. 1 has been made fast to the landing 14 by means of a pair of mooring lines 16 radiating out from a central cleat 18 as well as the two bumper and sling 10 arrangements in accordance with the invention. In general use, the sling portion 20 of the bumper and sling arrangement 10 extends between one attachment 46 on the sailboat 12 and another attachment 52 or 60 on the landing, wharf, pier mooring or, as previously mentioned, the objected to dock against. The bumper 22 is suspended from the sling 20 between the sailboat 12 and the landing 14 to cushion impact therebetween. The preferred manner of using the invention to assist in mooring or docking a boat will be described further below with reference to FIGS. 3 and 4.

Figure 2:
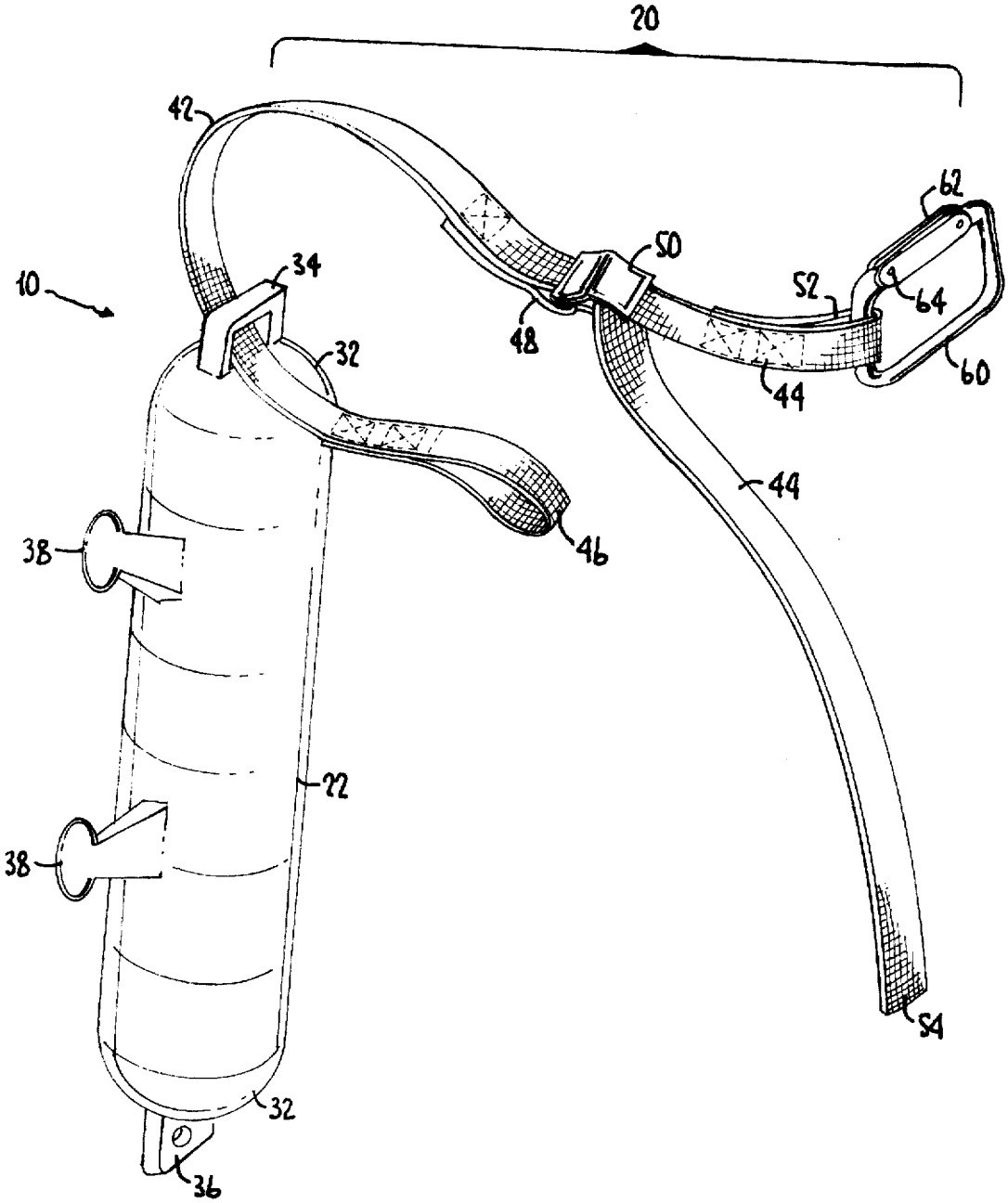
FIG. 2 is an enlarged perspective view of one bumper and sling arrangement from FIG. 1.

To turn to FIG. 2, the bumper 22 is generally an elongated cylindrical bladder that terminates between opposite hemispherical-cap ends 32. The bumper 22 has a generally seamless elastic wall defining an air-filled, substantially hollow body. The bumper 22's wall can be made of any suitably resilient and elastic material, preferably a polymer or moldable resinous material. Each cap end 32 includes a projecting flange portion 34 and 36, respectively. The bumper 22 includes a pair of cleat arms 38 extending out laterally from the cylindrical portion of the sidewall.

The sling portion 20 of the bumper and sling arrangement 10 comprises two separate lengths of web straps 42 and 44. One web strap 42 extends between opposite eye loops 46 and 48, one eye loop 48 of which is permanently fastened to a friction buckle 50. For convenience in this description, this strap 42 is termed "the fixed strap" in reference to its effective length in use being relatively fixed. The other strap 44 extends between one end formed 52 with an eye loop and an opposite regular and free end 54. Again, for convenience in this description, this strap 44 is termed "the adjustable strap" in reference to its effective length in use being relatively adjustable. The fixed and adjustable straps 42 and 44 are conjoined by the free end 54 of the adjustable strap 44 being inserted through the friction buckle 50 on the fixed strap 42.

On the eye loop 52 of the adjustable strap 44 there is suspended a carabiner 60. Carabiners are a type of safety hook more typically used by rock and mountain climbers in their sports in connection with rigging belay lines (this is not shown). The carabiner 60 is shown in a closed position in which it forms an oblong metal ring. It has a latch 62 which is arranged on a pivot pin 64 and spring (not in view) to resist deflecting inwardly to an open position (this is not shown). The latch 62 is constrained from overshooting the closed position by a catch (not in view) such that, overall, the carabiner 60 is used in this invention much like a safety hook.

Of the two cap ends 32 of the bumper 22, the flange 34 on the upper one (i.e., the direction "upper" being relative to how the bumper 22 is oriented in FIG. 2) forms a rectangular ring by virtue of a rectangular opening formed through it. This rectangular ring 34 is sized and arranged to allow relatively frictionless passage of either of the straps 42 or 44 through it (although the drawings consistently depict the fixed strap 42 inserted through it, which is done merely for convenience in this description).

Figure 3:
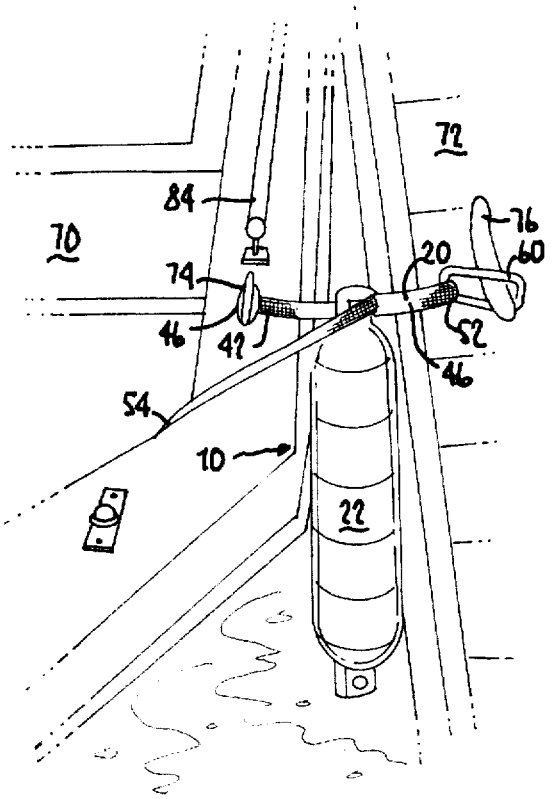
FIG. 3 is a perspective view of an alternate use environment for the bumper and sling arrangement in accordance with the invention, wherein a bass boat is shown docked in a slip of a boat dock.
Figure 4:
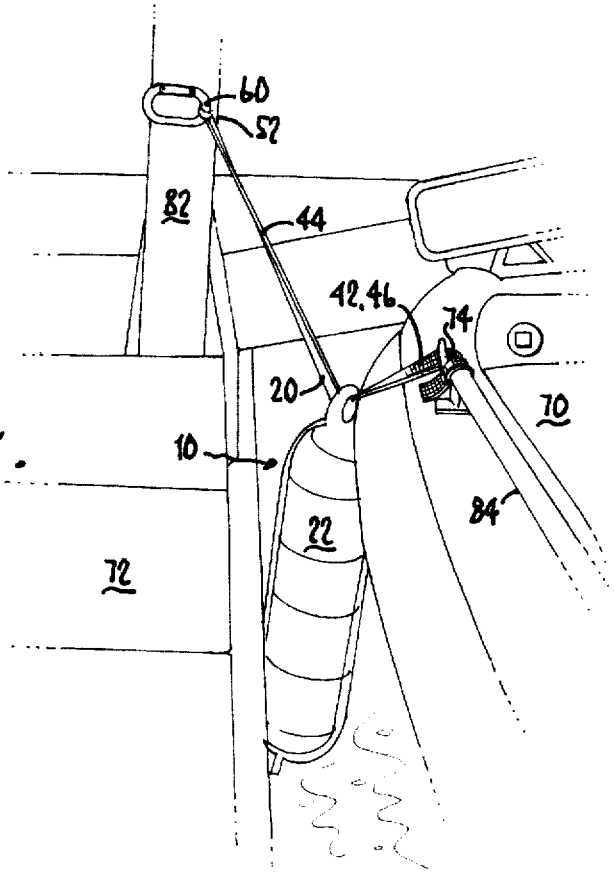
FIG. 4 is a perspective view comparable to FIG. 3 except from a reverse angle and showing an alternate method of attaching the sling to the dock.

FIGS. 3 and 4 show various use configurations for the bumper and sling arrangement 10 in accordance with the invention, to assist docking a boat. The operative use environment in FIGS. 3 and 4 is a bass boat 70 moored in slip of a conventional foam-floated, wooden boat dock 72, the dock 72 being conventional at least relative to what is commonly seen on the large man-made impoundments in the Midwest. The use environment shown by FIGS. 3 and 4 has been included in this description merely as a non-limiting example and just for the purpose of convenience in this description.

With reference to FIG. 3, the sling 20 extends between an attachment 46 to a cleat 74 on the boat 70 and an opposite attachment 60 to another cleat 76 on the dock 72. The sling 20 can be reckoned as having a left half (i.e., the direction "left" and the measure "half" being relative terms only with reference to FIG. 3) which defined by the fixed strap 42. The sling 22's other or right half is defined by the adjustable strap 44. The fixed strap 42's free eye loop 46 is formed into a "choker" hitch (i.e., this being akin to a slip knot) cinched around the boat cleat 74. The adjustable strap 44's carabiner 60 is simply clipped onto the dock cleat 76. The sling 20 has been tightened until the bumper 22 is lightly compressed between the boat 70 and dock 72.

A user, wanting to dock the boat 70 as shown in FIG. 3, would likely begin with the sling 20 slack, as shown by FIG. 4. FIG. 4 differs from FIG. 3 in at least these aspects. The fixed strap 42's free eye loop 46 is simply looped around the boat cleat 74. The adjustable strap 44's carabiner 60 has been arranged in a choker hitch around a vertical post 82 of the dock 72. The friction buckle 50 and adjustable strap 44's free end 54 are hidden from view. As previously stated, the sling 20 is slack.

An inventive aspect of the bumper and sling 10 arrangement is that it allows a user to tighten the sling 20 until the boat 70 compresses the bumper 22 against the dock 72 (which is shown by FIG. 3). To achieve this, a user grabs the free end 54 of the adjustable strap 44 (this is not shown) and pulls it through the friction buckle 50. The friction buckle 50 includes a cam (not shown) with a spring (also not shown) that urges the cam to ride against the webbing of the adjustable strap 44. The buckle 50's cam allows the adjustable strap 44 relatively free passage in the direction when the strap 44 is being tightened, but frictionally grabs and clamps down on the strap 44 should it move in the reverse direction (i.e., the direction toward going slack). Thus the friction buckle 50 allows uni-directional movement of the adjustable strap 54 in the direction of getting tighter. Accordingly, the user pulling the adjustable strap 44's free end 54 tightens the sling 20 indefinitely until the boat 70 has been pulled into the dock 72 to the extent that the bumper 22 is compressed comparably as shown by FIG. 3.

A user can release the cam of the friction buckle 50 by hand (this is not shown) and intentionally slacken the sling 20. However, the friction buckle 50 keeps the sling 20 normally taut, which is until released by the user. The compressibility of the bumper 22 assists keeping tension in the sling 20 despite relative movement between the boat 70 and dock 72. The friction buckle 50 works even better if it is resisting tension in the adjustable strap 44, and so the compressibility of the bumper 22 helps do just that.

Given the foregoing, the bumper and strap arrangement 10 in accordance with the invention helps assist boat docking because it allows a user to attach the ends 46 and 60 of the sling 20 while slack, and then tighten as desired (as shown by FIG. 3) by simply pulling the adjustable strap 44's free end 54. The tightened sling 20 generally constrains relative movement between the boat 70 and dock 72. The compressibility of the bumper 22 provides cushioning between the boat 70 and dock 72 such that incoming waves, while they may shift the boat 70 relative to the dock 72, do not heave and throw the boat 70 and dock 72 together (this is not shown). Accordingly, the bumper and strap arrangement 10 help preserve the boat 70 from damaged while docked.

The following aspects of the invention can be understood with general reference to FIGS. 1 through 4. Whereas FIG. 3 shows that the tightened sling 20 is relatively level, it need not be that way in use. That is, for example, the attachment 60 to the dock 72 can be relatively higher than the attachment 46 to the boat 70, and this kind of set up is shown in FIG. 4. The bumper 22 will automatically gravitate to a median position on the sling 20. Naturally, the sling 20 works comparably as well with the boat attachment 46 being higher relative to the dock attachment 60 (e.g., which is suggested by FIG. 1).

Also, the sling arrangement 20 can be configured in various ways, including without limitation some of the following. For example, the carabiner 60 is optional, and it may be omitted or else it may be included in duplicate in the sling arrangement 20 such that there are two carabiners or like hooks, safety hooks or connector hardware on the sling 20 (this is not shown), one each at the opposite ends 46 and 52 of the sling 20. The fixed strap 42 can sized to be a fraction of the length of the adjustable strap 44, or otherwise the bumper 22's rectangular ring 34 can be sized to allow the friction buckle 50 to pass through it, so that either way, the bumper 22 has unobstructed passage on the sling 20 between its opposite ends 46 and 52. Whereas FIGS. 3 and 4 show the fixed strap 42 likewise attached to the boat cleat 74, it could just as usefully be attached via a choker hitch to a rail 84 of the boat (this is not shown) or any other suitable attachment structure. FIG. 4 gives one example of how many diverse attachment structures the adjustable strap 44 can be attached to. Additionally, whereas the fixed strap 42 has always been depicted and mentioned as attached to the boat 70, this was done merely for convenience in this description and this can be varied because the attachment of the sling 20 can be reversed without detracting from the utility of the invention as a whole.

Figure 5:
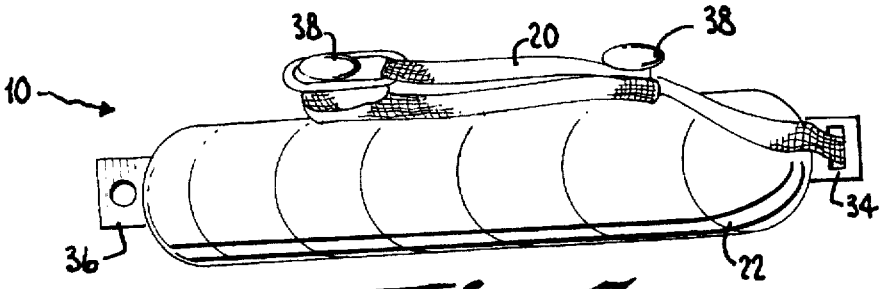
FIG. 5 is a reduced scale perspective view comparable to FIG. 2 except showing the sling lashed around cleats on the bumper in preparation for storage of the bumper and sling arrangement during non-use; and, FIG. 6 is a perspective view showing how a bumper and sling arrangement as shown by FIG. 5 may be stored during non-use.
Figure 6:
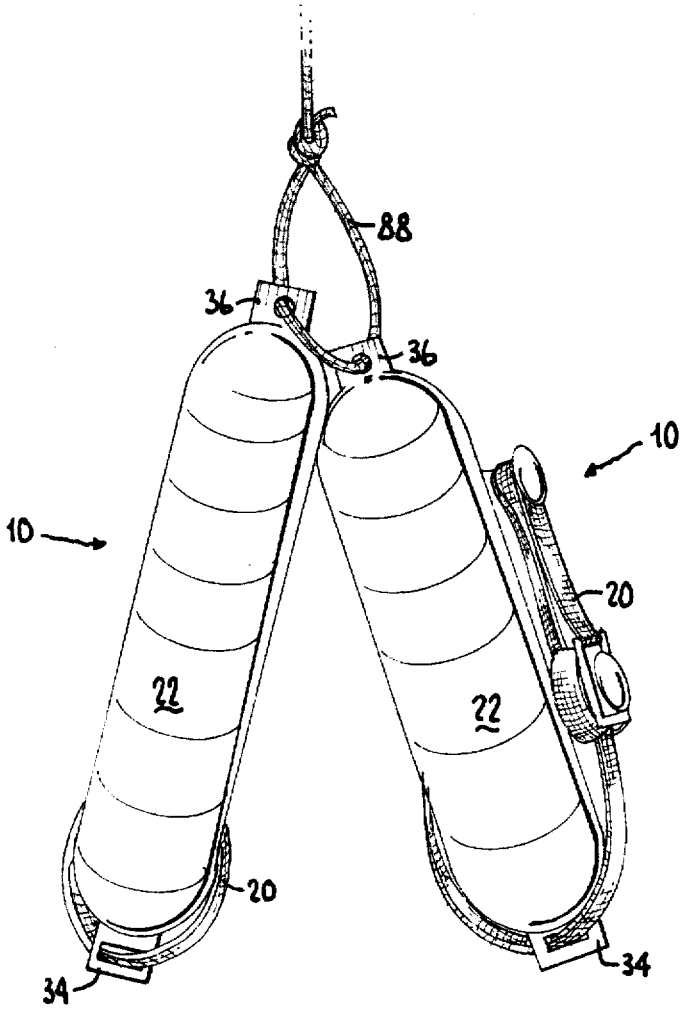

FIGS. 5 and 6 show aspects to the invention relating to its storage during non-use. The sling 20 can be lashed around the bumper 22's cleat arms 38 for tidy storage. The bumper 22's cap-end flange 36 opposite its rectangular ring 34 has an eye in it to allow suspending of the bumper 22 from a peg (not shown) or a rope 88 as shown in FIG. 6.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A bumper and sling arrangement to assist docking a boat securely against a docking object, comprising:

a generally tubular bumper terminating between opposite cap portions and formed from an elastic material to define a hollow and compressible body, at least one cap portion having a flange portion formed with an opening;

a sling that extends between opposite ends adapted for releasably attaching between a given mooring structure on the boat and another given mooring structure on the docking object;

unidirectional tightening means coupled to the sling between its ends and operative at least uni-directionally for tightening slackness out of the sling between its ends by a hand operation;

wherein the flange portion of the bumper is sized and arranged for the opening therein to allow sliding passage of the sling therethrough such that the bumper suspends from the sling when the sling ends are attached between the boat and the docking object and so gravitates to a position between the boat and docking object; whereby operation by a user of the unidirectional tightening means removes slackness out of the sling and pulls the boat into the docking object until the bumper is compressed therebetween to constrain and cushion relative movement between the boat and docking object.

2. The bumper and sling arrangement of claim 1, wherein the sling comprises web strap material.

3. The bumper and sling arrangement of claim 2, wherein the sling's opposite ends, which are adapted for attaching to various given mooring structures, comprise eye loops in the web strap material.

4. The bumper and sling arrangement of claim 3, wherein at least one of the sling's opposite ends further comprises, in combination with the eye loop thereof, a safety connector.

5. The bumper and sling arrangement of claim 4, wherein the safety connector comprises a carabiner.

6. The bumper and sling arrangement of claim 1, wherein the sling comprises two pieces of web strap material and the unidirectional tightening means comprises a friction buckle.

7. The bumper and sling arrangement of claim 6, wherein said at least one flange portion is sized and arranged such the opening therein defines a rectangular opening therethrough in accordance with allowing free passage of web strap material.

8. The bumper and sling arrangement of claim 1, wherein the bumper further comprises a pair of cleat arms located between the opposite cap portions and projecting generally laterally out therefrom, the cleat arms allowing the sling to be lashed around themselves for tidy storage of the sling during non-use.

9. The bumper and sling arrangement of claim 1, wherein the cap end opposite said at least one cap end further comprises a flange portion formed with an aperture therethrough to allow the bumper and sling arrangement to be suspended from a peg or a rope and the like during non-use.

* * * * *